US007798198B2

(12) United States Patent
Rejc et al.

(10) Patent No.: US 7,798,198 B2
(45) Date of Patent: Sep. 21, 2010

(54) WEIGHT COMPENSATION DEVICE FOR A LIFTING DOOR

(75) Inventors: Gabrijel Rejc, Landshut (DE); Matjaz Sentjurc, Velen (SK); Joze Breznikar, Vrhnika (SK)

(73) Assignee: Efaflex Inzeniring D.O.O. Ljubljana, Ljubljana (SI)

( * ) Notice: Subject to any disclaimer, the term of this patent is extended or adjusted under 35 U.S.C. 154(b) by 261 days.

(21) Appl. No.: 12/083,356

(22) PCT Filed: Oct. 16, 2006

(86) PCT No.: PCT/EP2006/009973

§ 371 (c)(1),
(2), (4) Date: Jun. 26, 2008

(87) PCT Pub. No.: WO2007/045422

PCT Pub. Date: Apr. 26, 2007

(65) Prior Publication Data

US 2008/0295411 A1 Dec. 4, 2008

(30) Foreign Application Priority Data

Oct. 17, 2005 (DE) ..... 10 2005 049 585

(51) Int. Cl.
*E06B 9/08* (2006.01)
*E05F 15/00* (2006.01)
*E05F 1/00* (2006.01)
*E05D 13/00* (2006.01)

(52) U.S. Cl. ..... 160/133; 160/191; 160/193; 49/445; 16/194; 16/197

(58) Field of Classification Search ..... 160/133, 160/314, 317, 319, 191, 192, 193, 189; 254/372, 254/382, 358; 49/445; 474/206; 16/194, 16/197

See application file for complete search history.

(56) References Cited

U.S. PATENT DOCUMENTS 812,722 A * 2/1906 Cahill ..... 160/116
1,183,402 A * 5/1916 Prescott ..... 160/193

(Continued)

FOREIGN PATENT DOCUMENTS

DE 255 647 10/1911

(Continued)

OTHER PUBLICATIONS

International Search Report for PCT/EP2006/009973, mailed Jan. 18, 2007.
Examination Report for DE 10 2005 049 585.0 dated Sep. 19, 2006.

*Primary Examiner*—Katherine W Mitchell
*Assistant Examiner*—Jaime F Cardenas-Garcia
(74) *Attorney, Agent, or Firm*—Nixon & Vanderhye PC

(57) ABSTRACT

A weight compensation device for a lifting door, includes a spring element and a tensile element, which can be wound onto or unwound from a winding device in such a way that the spring element achieves its greatest pre-tension when the door leaf is in the closed position and is essentially tension-free when the door leaf is in the open position. The tensile element is narrower at the end facing the winding device than at the end facing the spring element and the winding device includes a guide device, which is used to wind the tensile element in such a way that the wound layers lie adjacent to one another without making contact. To achieve this, the guide faces around the perimeter of the guide device have a continuously increasing radius in the winding direction. This enables the provision of a weight compensation device that achieves the torques required for effective weight compensation by means of a simple construction. This also relates to a lifting door that is equipped with a weight compensation device of this type.

7 Claims, 5 Drawing Sheets

U.S. PATENT DOCUMENTS

| | | | | | |
|---|---|---|---|---|---|
| 3,095,922 | A | * | 7/1963 | Frazier | 160/191 |
| 4,947,937 | A | * | 8/1990 | Searer et al. | 160/133 |
| 5,484,007 | A | * | 1/1996 | Rejc | 160/133 |
| 5,488,982 | A | * | 2/1996 | Rejc | 160/133 |
| 5,632,317 | A | * | 5/1997 | Krupke et al. | 160/265 |
| 5,682,937 | A | * | 11/1997 | Decrane et al. | 160/133 |
| 5,996,670 | A | * | 12/1999 | Igarashi | 160/133 |
| 6,119,758 | A | * | 9/2000 | Coenraets | 160/273.1 |
| 6,883,577 | B2 | * | 4/2005 | Frede | 160/133 |
| 2004/0163777 | A1 | * | 8/2004 | Frede | 160/268.1 |
| 2005/0115688 | A1 | * | 6/2005 | Frede | 160/268.1 |
| 2008/0251220 | A1 | * | 10/2008 | Rejc et al. | 160/266 |

FOREIGN PATENT DOCUMENTS

| | | | |
|---|---|---|---|
| DE | 39 05 224 | A1 | 8/1990 |
| DE | 40 15 214 | A1 | 11/1991 |
| DE | 40 15 215 | A1 | 11/1991 |
| DE | 298 04 411 | U1 | 7/1998 |

* cited by examiner

WEIGHT COMPENSATION DEVICE FOR A LIFTING DOOR

This application is the U.S. national phase of International Application No. PCT/EP2006/009973, filed 16 Oct. 2006, which designated the U.S., and claims priority to German Patent Application No. 10 2005 049 585.0, filed 17 Oct. 2005, the entire contents of each of which are hereby incorporated by reference.

RELATED APPLICATION

This application is related to copending, commonly assigned application Ser. No. 12/089,815 filed Apr. 10, 2008, entitled HIGH SPEED INDUSTRIAL ROLLER DOOR, which names Messrs. Rejc, Sentijurc and Breznikar as co-inventors (published as US-2008-0251220 A1).

BACKGROUND

1. Technical Field

The invention relates to a weight compensation device for a lifting door, in particular for a high-speed industrial door, having a spring element, a tensile element and a winding device, wherein one end of the spring element can be secured to the floor, wherein the tensile element is attached by one end to the spring element and by the other end to the winding device, wherein the winding device can be coupled to a drive of the lifting door, and wherein the tensile element can be wound onto the winding device or unwound from it in such a way that the spring element has its maximum prestress when a door leaf of the lifting door is in the closed position, and is essentially relieved of stress when the door leaf is in the open position.

2. Related Art

In order to balance the weight of a door leaf of a lifting door it is known to provide weight compensation devices. These typically have spring elements which are under maximum prestress when the door is closed and therefore assist the opening movement of the door leaf. However, this not only results in a reduction in the necessary drive torques when such a lifting door is actuated but also, given the correct adjustment of the arrangement, prevents sudden dropping of the door leaf in the event of a fault.

For this purpose, the prestressing force of the spring element is selected such that it exceeds the respective weight of the free length of the door leaf, that is to say of the door leaf section which is not moved out of the door opening, up to a desired balance point in all cases. In modern industrial doors, this balance point is typically at a door opening height of 2.5 m. In other words, the door leaf moves automatically as far as an opening position with a passage height of 2.5 m if, owing to a defect in the drive mechanism or due to manual release, for example in the case of a power failure, a blocking effect is no longer provided by the drive.

In lifting doors with relatively low power requirements it is known in this context, for example, to use torsion springs for the weight compensation. Said springs are arranged coaxially with respect to a drive shaft and are completely stressed in the closed position of the door leaf and correspondingly relieved of stress when the door leaf is opened. However, such torsion springs are subject to increased wear, for which reason their service life is limited. In particular when there is a frequent and sudden reversal of direction of the movement sequence of the lifting door such torsion springs are subject to considerable dynamic tension peaks owing to the jolting movements.

Therefore, weight compensation devices of a design such as is explained, for example, in WO 91/18178 have gained a widespread acceptance for such application purposes and in particular in high-speed industrial doors. Said weight compensation devices have a spring element, typically a helical spring, and a tensile element which is attached thereto and is generally in the form of a belt. The lower end of the spring element is fixedly connected to the floor here while its upper end is coupled by the tensile element to a winding shaft which is arranged at the lintel side of the lifting door. The tensile element is wound up onto this winding shaft here in the course of the closing process of the lifting door, and is wound up with layers which rest directly one on the other so that the spring element is increasingly stressed. On the other hand, the opening movement of the door leaf is associated with an unwinding process of the tensile element from the winding shaft so that in this context the spring element is relieved of stress. The winding shaft is coupled to the drive of the lifting door here.

This method of weight compensation has also proven itself because it results in the characteristic of the weight compensation process being adjusted to a satisfactory degree. While the gravitational force of the door leaf section which is located in the plane of the door in the course of an opening movement or closing movement changes essentially linearly as a function of the progress of the movement, the spring element for this known weight compensation device does not typically exhibit a linear characteristic curve profile. In order, on the one hand, to keep the necessary engine torques low here and, on the other hand, nevertheless to produce the desired balance point at, for example, a height of 2.5 m, structural adaptation of various parameters such as the selection of the core diameter of the winding shaft, the thickness of the tensile element and the length at rest and spring strength of the spring element is possible depending on the type of door leaf and the predefined door height. In view of the large number of different dimensions of lifting doors which are applied in practice and the types of door leaves which are available for said doors, such as flexible curtains, slatted armor etc., a considerable degree of expenditure is therefore necessary in order to make available a suitably dimensioned weight compensation means for each door system.

In addition, in modern high-speed industrial roller doors such as are described, for example, in DE 40 15 215 A1, DE 199 15 376 A1 and DE 102 36 648 A1, door leaves are guided in lateral guide rails in such a way that when the lifting door is opened they are accommodated in a contact free manner in the lintel area of the door opening. Such a configuration generally requires comparatively few rotations of the drive shaft so that also only a relatively small number of revolutions are available for the conventionally used winding shaft for the tensile element of the weight compensation device. Conventionally, in order to achieve the desired prestressing force of the spring element it is therefore frequently necessary to accept the expenditure on structural adaptations such as, for example, an additionally arranged speed-changing transmission mechanism.

BRIEF SUMMARY

The exemplary embodiment is therefore based on the object of developing a weight compensation device of the generic type in such a way that the torque values which are necessary for effective weight compensation can be made available with little structural expenditure, and in addition an increased service life is achieved.

This object is achieved by means of a weight compensation device having the features of claim 1. Said weight compensation device is distinguished in particular by the fact that the tensile element has a smaller width at the end facing the winding device than at the end facing the spring element, and that the winding device has a shaft and a guide device which is mounted thereon and by means of which the tensile element can be wound up in such a way that the windings are not in contact with one another, wherein, for this purpose, the guide device has, on its circumference, guide faces with a radius which increases continuously in the winding direction.

In this context, the exemplary embodiment has for the first time recognized that it is advantageous to wind up the tensile element in a contactless manner.

As a result, by virtue of the contact-free winding, increased radii are produced automatically in the wound portion, for which reason a small number of revolutions of the winding device is already sufficient to produce the desired prestress of the spring element. This is advantageous in particular in the case of door leaves which are guided in a contactless manner in the wound portion since here also only a reduced number of rotational movements of the drive shaft are provided compared to conventional door leaves which are wound in a contact-forming manner. As a result, according to the invention it is generally possible to dispense with an additional speed-changing transmission mechanism etc. and also to drive the weight compensation device directly by means of the drive shaft for the door leaf. The design of a lifting door which is equipped with the weight compensation device according to the invention can therefore be made simple in structural terms. This is in turn advantageous in respect of reduced wear and the improved service life of such a lifting door.

In addition, the relatively large radii which are therefore present in the wound portion result in relatively large lever lengths, which in turn result in larger torques than with conventional, contact-forming winding-up of the tensile element. The weight compensation device according to the invention can therefore also be used advantageously with very large and heavy doors.

In addition, the configuration according to the exemplary embodiment has the advantage that the selection of the effective radius and/or of the effective lever length on the guide device can be made independent of the thickness of the tensile element since for this purpose correspondingly configured guide faces simply need to be formed on the guide device. As a result, a person skilled in the art can individually adapt the weight compensation means to the respective dimensions of the lifting door leaf and its weight through selective shaping of the guide device alone without, for example, having to take into consideration the thickness of the tensile element, the core diameter of a winding shaft, etc. for this purpose.

A further advantage of the weight compensation device according to the exemplary embodiment is that, owing to its specific configuration, the tensile element can be wound up free of axial displacement. As a result, one-sided stresses on the tensile element can be avoided, and the wear on said element which is certainly stressed during use can therefore be kept small. This has an advantageous effect on the service life of the weight compensation device according to the exemplary embodiment.

In this context, WO 2004/076795 A1 has already disclosed configuring the door leaf of a lifting door in such a way that said door leaf has a smaller width at the lintel-side end than at the floor-side end. In addition, this document discloses providing two axially spaced-apart modules on which the door leaf can be wound up in a contactless manner, wherein the two modules have, on their circumference, guide faces with a radius which increases continuously in the winding direction. However, this configuration relates exclusively to a possibility of winding up a door leaf in a contactless manner and therefore avoiding scratching or damage thereto. In respect of weight compensation, this document relates to the conventional configuration with a helical spring and tensile belt which is explained above and in which the tensile belt is wound up in a contact-forming manner on a winding shaft. This document does not contain any suggestion to provide contactless winding-up of the tensile belt of the weight compensation means instead of or in addition to the door leaf. In addition, WO 2004/076795 A1 also does not concern itself in the slightest with the problem of setting a suitable weight compensation characteristic on such a lifting door. Clearly, when developing this known lifting door the problems on which the exemplary embodiment is based were not recognized, for which reason no suggestions for solving the problem which is defined according to the exemplary embodiment can be found here either.

Advantageous developments of the weight compensation device according to the exemplary embodiment are the subject matter of dependent claims 2 to 6.

For example, the width of the tensile element can be increased incrementally from the end facing the winding device to the end facing the spring element, wherein the guide device has at least two guide sections which are each embodied in the form of a spiral and are offset axially with respect to one another in such a way that an outer guide section pair whose minimum guide face radius corresponds to the maximum guide face radius of the inner guide section adjoins an inner guide section. As a result, with comparatively little structural expense, it is possible to implement an arrangement according to the invention since the guide faces on each guide section have to be made available only in one plane. At the point at which the inner guide section can no longer provide the corresponding spiral-shaped guide face, that is to say after one complete revolution, according to the exemplary embodiment, an axially outer guide section pair with an adapted radius performs the further guide function in conjunction with a correspondingly adapted, wider section of the tensile element. With this configuration it is already possible to implement two complete revolutions of the guide device with a radius which increases continuously in the winding direction, which is sufficient for many applications. If more than two revolutions of the guide device are necessary, further outer guide section pairs which are of corresponding design and in turn interact with an even wider section of the tensile element may be adjoined.

Alternatively to this it is also possible for the width of the tensile element to increase continuously from the end facing the winding device to the end facing the spring element, and for the guide device to have two guide spirals which, starting from a central section, extend axially further apart from one another toward the outside with an increasing radius. This also permits contact-free winding of the tensile element, but a three-dimensional configuration of the guide faces is necessary. However, this configuration also makes it possible to make available the inventively provided guide faces with a radius which increases continuously in the winding direction.

If the tensile element is a chain, a stable configuration, which is nevertheless very flexible in the winding direction, of this component of the weight compensation device according to the invention can be made available. In particular, such a chain has a very high tensile strength, for which reason it can be applied particularly advantageously on lifting doors with large dimensions of, for example, 8 m in width and 6 m in height.

Alternatively it is also possible for the tensile element to be embodied as a belt. This configuration is particularly advantageous if the width of the tensile element increases continuously from the end facing the winding device to the end facing the spring element since such an embodiment is easier to implement in fabrication terms with a belt than with a chain. For example metal or plastic and here, in particular, fiber-reinforced plastics are possible as the material for such a belt.

It is also advantageous if the spring element has at least one helical spring. Compared to other spring-elastic elements which per se can certainly also be used, helical springs have already gained acceptance to a large extent in practice with known weight compensation devices owing to their robustness and reliability. In addition, with such helical springs it is easily possible to make available the desired spring properties.

According to a further aspect of the exemplary embodiment, according to claim 7 a lifting door is made available which has a door leaf which covers the door opening and which can be moved from an open position into a closed position and vice versa by means of a drive, wherein this lifting door is equipped with a weight compensation device according to the exemplary embodiment. This lifting door therefore advantageously benefits from the advantageous properties of the weight compensation device according to the exemplary embodiment, with the result that it has a relatively small number of components and is particularly robust, unsusceptible to wear and has a long service life. In particular, as a result it is possible to make available, in a particularly advantageous way, high-speed industrial doors which can be operated reliably and speeds above 1 m/s and preferably above 3 m/s.

BRIEF DESCRIPTION OF THE DRAWINGS

The invention will be explained in more detail below using exemplary embodiments and with reference to the figures in the drawing, of which.

DETAILED DESCRIPTION OF EXEMPLARY EMBODIMENTS

Figure 1:
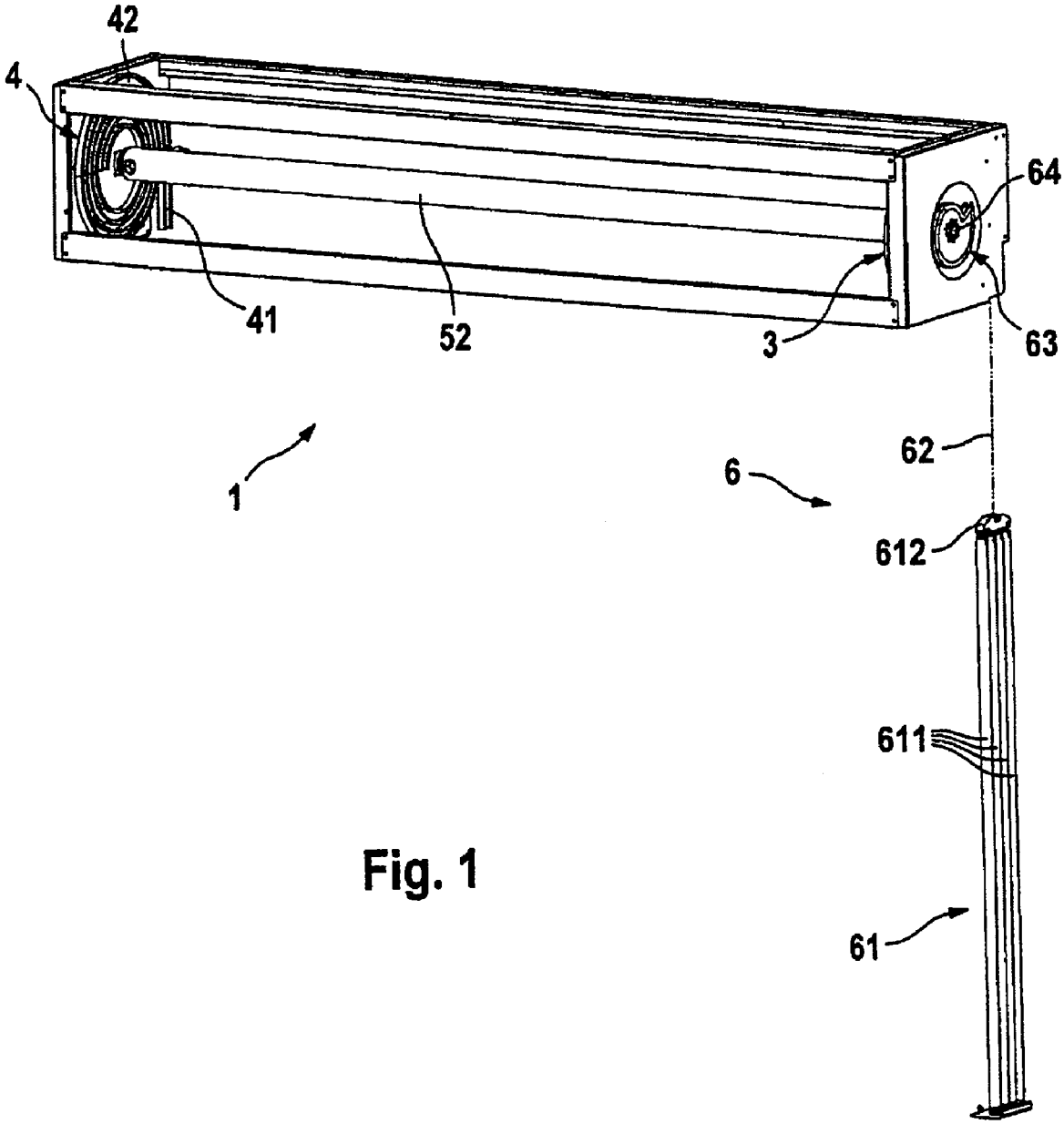
FIG. 1 is a perspective view of a lifting door which is equipped with the weight compensation device according to the exemplary embodiment, in which the door leaf and further components of the lifting door are omitted for the sake of clarity.
Figure 2:
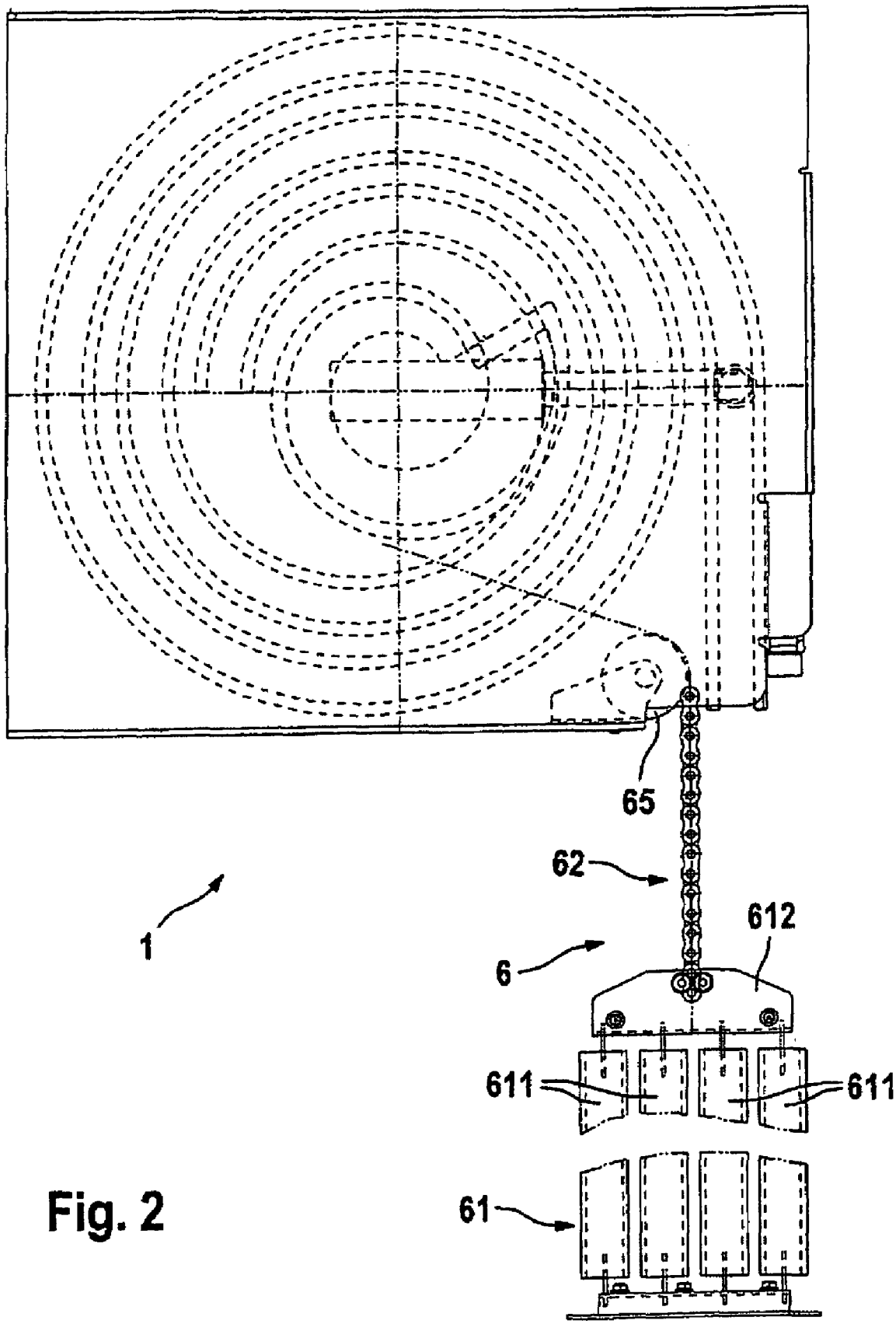
FIG. 2 is a side view of the lifting door according to FIG. 1, in which the door leaf is also omitted.
Figure 3:
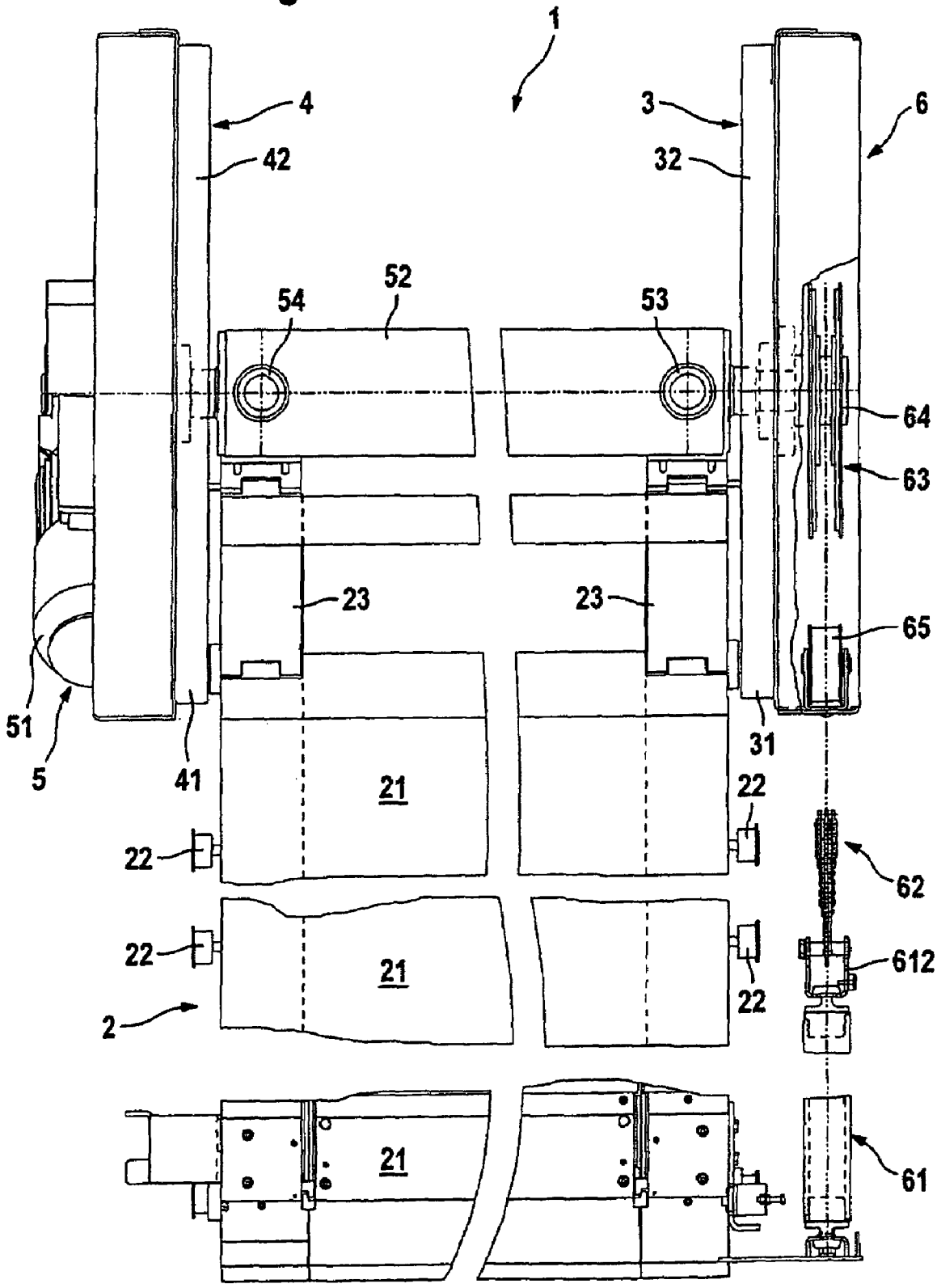
FIG. 3 is a front view of the lifting door according to FIG. 1.
Figure 4:
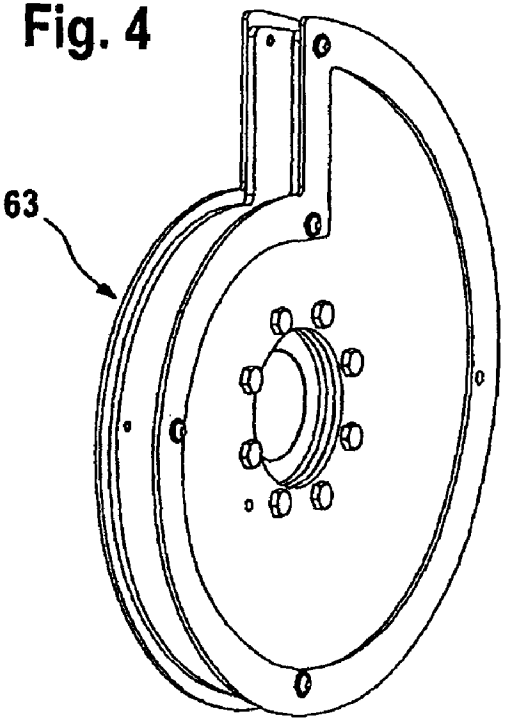
FIG. 4 is a perspective view of a guide device of the weight compensation device according to the exemplary embodiment.
Figure 5:
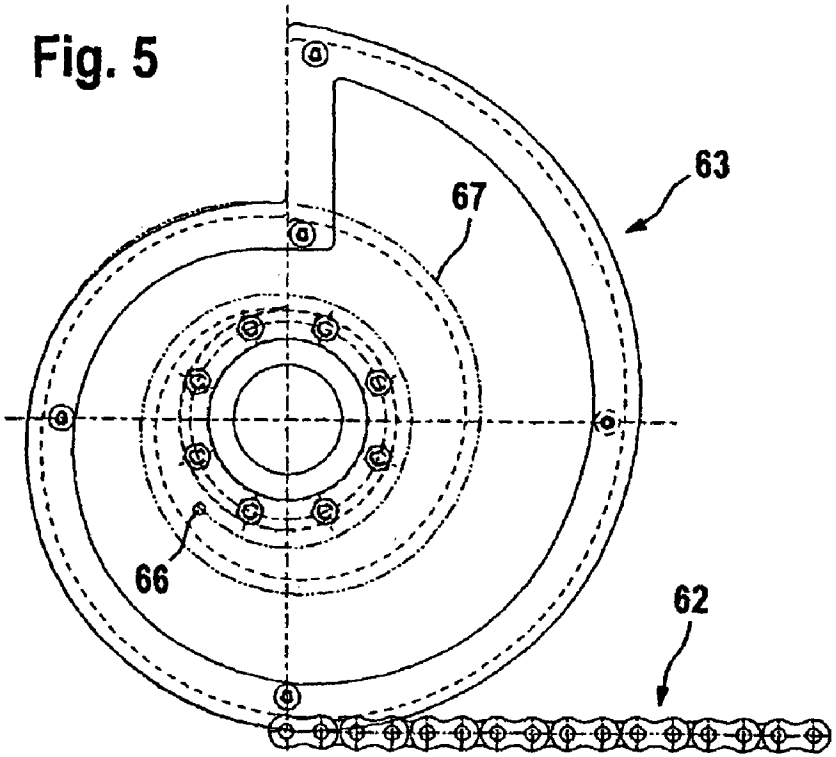
FIG. 5 is a side view of the guide device according to FIG. 4 with a schematic illustration of the movement path of the tensile element.

According to the illustrations in FIGS. 1 to 3, a lifting door 1 which is embodied as a roller door has a door leaf 2 which has lamellas 21 which are coupled to one another in an articulated manner and which are guided in lateral guides 3 and 4 by means of rollers 22. The rollers 22 are mounted here on lateral hinge belts 23 which pick up the tensile loads and thrust loads on the door leaf 2 and hold the lamellas 21.

The guides 3 and 4 each have a vertical section 31 and 41, respectively, whose upper end can be seen in particular in FIG. 2 and which extends in a conventional way from the lintel-side end which is shown as far as the floor-side end of the lifting door 1, but this, along with the frames, is not shown in more detail in the figures. At the lintel side, the vertical sections 31 and 41 each open into a spiral section 32 and 42, respectively, which is in the form of a round spiral and in which the door leaf 2 is accommodated in the open position of the lifting door 1 in such a way that the individual lamellas 21 are placed in a spiral-shaped wound portion without contact with one another.

The movement of the door leaf 2 between its end positions is brought about by a drive 5. The latter has a motor 51, here a winding motor, which is accommodated in the vicinity of a lateral frame in the door lintel area and is coupled there directly to a drive shaft 52. The drive shaft 52 engages through the spiral section 32 and 42, respectively, of the guides 3 and 4, respectively, in a central area. Extension arms 53 and 54 (only indicated in the figures) are arranged on the drive shaft on each side of the door opening, in each case adjacent to the spiral section 32 and 42, respectively. Said extension arms 53 and 54 each engage centrally through the drive shaft 52 and protrude radially from it. The distance between the coupling points of the extension arms 53 and 54 on the door leaf 2 and the pivoting axis, coinciding with the drive shaft 52, of the extension arms 53 and 54 is variable here. A lifting door which is driven in this way is explained in more detail in the parallel German patent application with the patent attorney file number EF01K48 and the same filing date. Reference is made to the entire contents of this parallel patent application in respect of details of this method of driving and its function.

As is also apparent from FIGS. 1 to 3, the lifting door 1 has a weight compensation device 6. The latter contains a spring element 61, a tensile element 62 and a winding device which has a guide device 63 and a shaft 64. The guide device 63 is mounted here on the shaft 64. As is also apparent from the figures, the shaft 64 is coupled directly to the drive shaft 52 and also rotates with it when the motor 51 is activated.

In the present embodiment, the spring element 61 has four helical springs 611 which are secured to the floor. By their other end the helical springs 611 are fixedly connected via a strap 612 to the tensile element 62 which is embodied here as a chain. The lintel-side end of the tensile element 62 is deflected about a deflection roller 65 in the vicinity of the door lintel and is fastened to the guide device 63.

The guide device 63 together with the tensile element 62 are shown in more detail in FIGS. 4 to 7. As is apparent in particular from FIGS. 5 and 6, the tensile element 62 is wound up in a contact-free manner by means of the guide device 63 in the course of the closing movement of the door leaf 2. The tensile element 62 is secured here to an attachment point 66 on the guide device 63, and in the wound-up state it extends in accordance with the dash-two-dot line 67 in FIG. 5, which line describes the center of the chain run.

As is apparent from FIGS. 4 to 7, the guide device 63 has an inner guide section 631, a first outer guide section 632 and a second outer guide section 633. The guide sections are embodied here in such a way that, on their circumference, they have guide faces with a radius which increases continuously in the winding direction. In addition, the two outer guide sections 632 and 633 are embodied as a pair of disks 632*a* and 632*b* as well as 633*a* and 633*b*, which each axially enclose the inner guide section 631. The second outer guide section 633 also axially encloses the first outer guide section 632.

Furthermore, the maximum guide face radius of the inner guide section 631 corresponds to the minimum guide face radius of the first outer guide section 632 so that a continuous transition is produced here. In the same way the maximum guide face radius of the first outer guide section 632 is configured so as to correspond to the minimum guide face radius of the second outer guide section 633.

Figure 7:
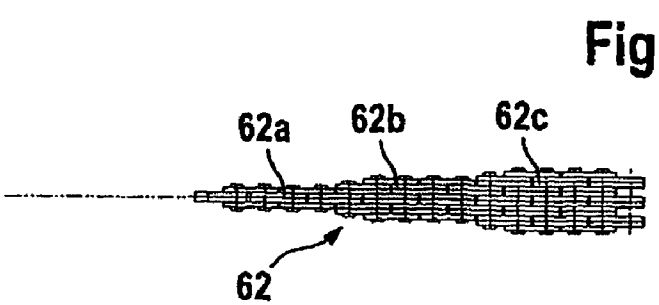
FIG. 7 is a plan view of the tensile element.
Figure 6:
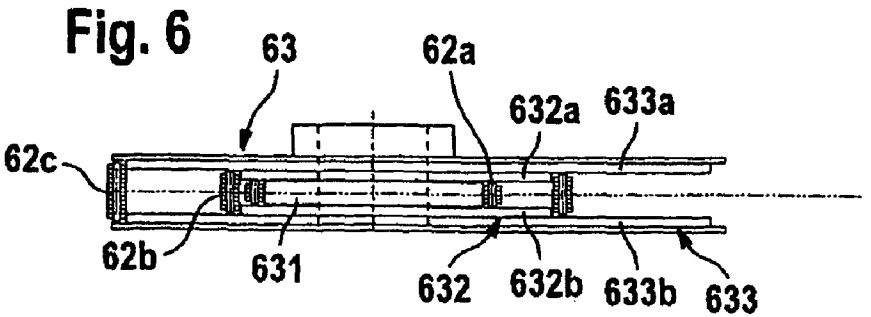
FIG. 6 is a plan view of this guide device.

As is apparent in particular from FIG. 7, the tensile element 62 is embodied here in such a way that it has an increasing width from its lintel-side end in the direction of the floor-side end. In the present exemplary embodiment, the tensile element 62 has three different widths here corresponding to the number of guide sections. In FIG. 6, the state of the chain in which it comes to rest on the guide sections of the guide device 63 is shown in section for the sake of clarity. It is apparent here that the tensile element 62 is therefore wound up in a contact-free manner in the guide device 63 and without axial displacement with respect to the shaft 64.

For this purpose, the width of the tensile element 62 at the lintel-side end is selected in such a way that this section 62*a* can be wound up directly onto the inner guide section 631. A second section 62*b* of the tensile element 62 with an average width corresponds to the width of the first outer guide section 632 so that this section 62*b* of the tensile element 62 is wound onto its guide faces. Correspondingly, the width of a subsequent, widened section 62*c* of the tensile element 62 is adapted to the width of the second outer guide section 633 so that said section 62*c* comes to rest on the guide faces of said guide section 633. As a result of the adaptations of the radii of the individual guide sections 631 to 633 which are explained above, a continuous transition is produced in the course of the winding process, i.e. uniform winding-up of the tensile element 62 during the closing movement of the door leaf 2.

Figure 8:
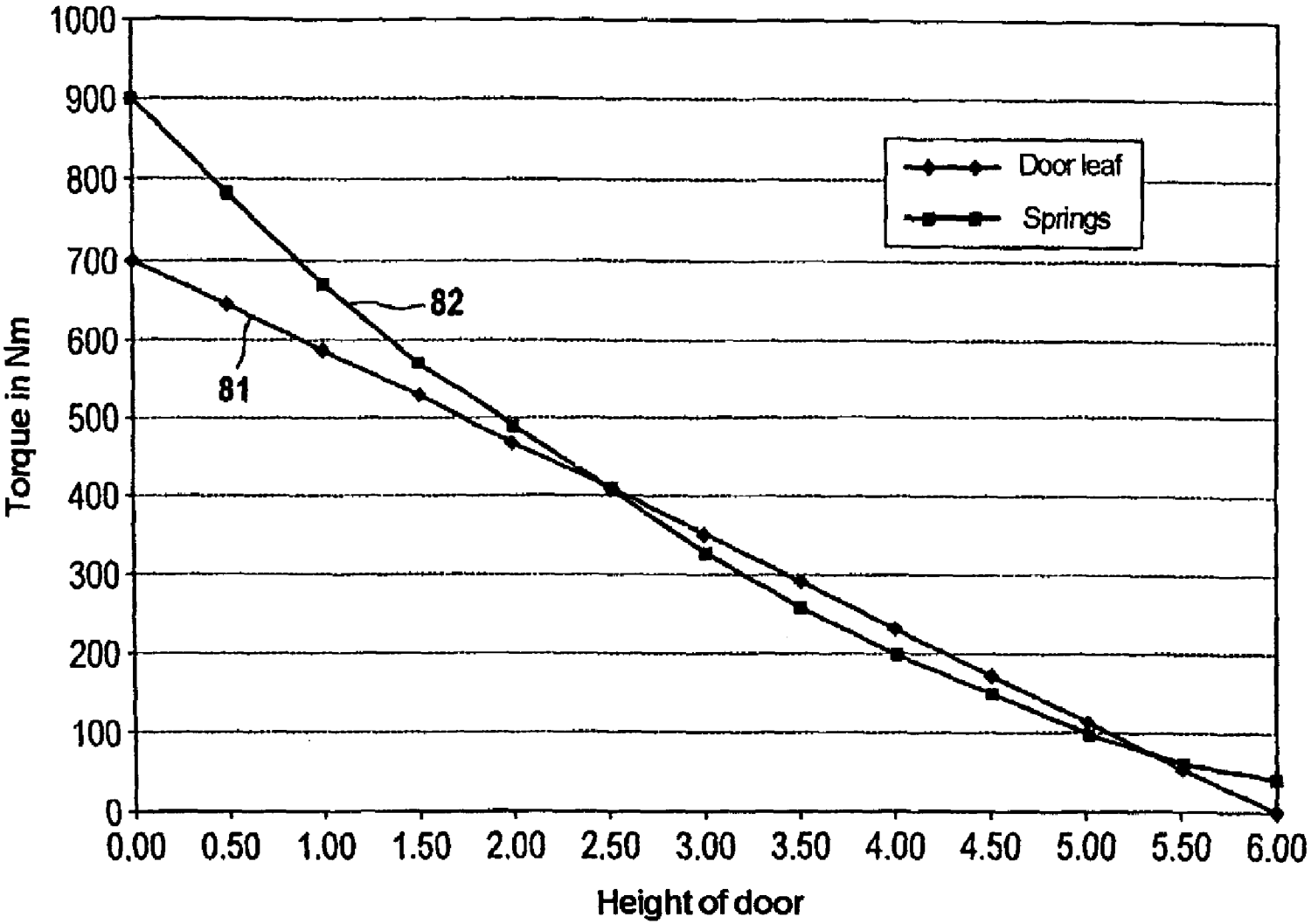
FIG. 8 shows the characteristic of the weight compensation device according to the exemplary embodiment.

FIG. 8 is a schematic illustration, by means of characteristic curves, of the characteristic of the weight compensation device 6. Here, an exemplary door height of 6 m is shown, with the respective clear height of the remaining door opening being plotted on the right. The value "0.00" therefore stands for the completely closed lifting door 1, while the value "6.00" stands for the completely open lifting door 1. In the upward direction, the torque which acts on the drive shaft 52 based on the weight of the free door leaf section is indicated with a characteristic curve 81 through the lozenges, while the torque which acts on the drive shaft 52 as a result of the weight compensation device 6 is indicated by means of a characteristic curve 82 which runs through the squares. It indicates the torque which is brought about by the spring element 61.

As is apparent from FIG. 8, the weight compensation device 6 is set in such a way that when the door is closed the spring element 61 is extended to such an extent that a torque of approximately 200 Nm which is in excess of the torque produced by the gravitational force of the door leaf is present. This ensures that when the closed lifting door 1 is actuated, the door leaf 2 moves upward, without additional drive, approximately as far as that height at which the gravitational force of the free door leaf section is in equilibrium with the applied spring force of the spring element 61. According to FIG. 8, this is a point at which the two lines intersect, i.e. at a height of approximately 2.5 m.

When the door leaf opens further, the respectively necessary drive torque is virtually in equilibrium with the torque which is made available by the weight compensation device 6 so that the drive 5 essentially only has to act against the frictional forces which are present.

When the door is opened completely, the torque which is made available by the weight compensation device 6 as per the illustration in the diagram in FIG. 8 in turn exceeds the torque which is produced by the gravitational force of the door leaf 2 at the drive shaft 52 so that the door leaf is reliably prevented from dropping even when there is a defect in the drive 5.

In addition to the embodiments which are explained, the invention also permits further configuration approaches.

The weight compensation device 6 does not have to be mounted on a shaft which is directly coupled to the drive shaft 52 but rather can also be mounted on a separate bearing shaft. In particular it is also possible that the motor 51 does not drive the drive shaft 52 or the drive shaft sections and/or the weight compensation device 6 directly but rather indirectly via toothed belts, chains, a gear mechanism, etc. However, for the sake of the most compact arrangement possible a direct drive of these components is to be preferred.

Furthermore, for the lifting door 1 it is essentially irrelevant which type of door leaf 2 is present. The application of force to the lintel-side end of the door leaf 2 which is provided according to the invention can also be applied to slatted armor, within the scope of flexible curtains which are extended across the door, door leaves as described in DE 102 36 648 A1, etc. Depending on the type of door leaf 2 and/or the field of application of the lifting door 1 it may also be possible to be able to dispense with the lateral guide rollers 22 on the door leaf 2 and simply guide the latter in a sliding manner. This is advantageous in particular in applications of the lifting door 1 in clean rooms, in the pharmaceutical industry, etc. since it can then be kept clean more effectively.

In addition, the drive of the door leaf 2 can also be configured in a different way from that shown. In particular, it is possible, for example, in the way which is shown, for example, in WO 91/18178, to apply force to the floor-side end of the door leaf 2. The weight compensation device 6 according to the invention can also be used with further driving methods.

Furthermore, it is also possible to provide such a weight compensation device in both lateral frames. In particular in the case of door leaves with relatively large widths this may be advantageous for reducing one-sided stresses on the arrangement.

The number of helical springs 611 of the spring element 61 is determined according to the given loads, i.e. in particular according to the type of door leaf, its weight and its dimensions. Furthermore it is also possible to provide other spring-elastic elements such as, for example, extendable belts, etc., instead of helical springs.

The tensile element 62 does not have to be configured as a chain but rather can also be provided in the form of a belt. A dimensionally stable material such as, in particular, a metal is to be preferred for this.

The number of guide sections on the guide device 63 depends on the length of the tensile element 62 and therefore indirectly on the height of the door. Accordingly, more or fewer than the described three guide sections may also be provided.

In addition it is also possible to use a guide device which has two guide spirals which, starting from a central section, extend axially further apart from one another toward the outside with an increasing radius. This embodiment is suitable in particular in conjunction with a tensile element whose width increases continuously or at least virtually continuously from the end facing the winding device to the end facing the spring element and which can be wound up thereon directly in a contactless manner and free of axial offset. In this embodiment the tensile element is preferably embodied as a belt.

What is claimed is:

1. A weight compensation device for a lifting door, in particular for a high-speed industrial door, said device comprising:

a spring element, a tensile element and a winding device, wherein one end of the spring element can be secured to the floor, wherein the tensile element is attached by one end to the spring element and by the other end to the winding device, wherein the winding device can be coupled to a drive of the lifting door, and wherein the tensile element can be wound onto the winding device or unwound from it in such a way that the spring element has its maximum prestress when a door leaf of the lifting door is in the closed position, and is essentially relieved of stress when the door leaf is in the open position, wherein the tensile element has a smaller width at the end facing the winding device than at the end facing the spring element, and the winding device has a shaft and a guide device which is mounted thereon and by means of which the tensile element can be wound up in such a way that the windings are not in contact with one another, wherein, for this purpose, the guide device has, on its circumference, guide faces with a radius which increases continuously in the winding direction.

2. The weight compensation device as claimed in claim 1, wherein the width of the tensile element increases incrementally from the end facing the winding device to the end facing the spring element, and the guide device has at least two guide sections which are each embodied in the form of a spiral and are offset axially with respect to one another in such a way that an outer guide section pair whose minimum guide face radius corresponds to the maximum guide face radius of the inner guide section adjoins an inner guide section.

3. The weight compensation device as claimed in claim 1, wherein the width of the tensile element increases continuously from the end facing the winding device to the end facing the spring element, and the guide device has two guide spirals which, starting from a central section, extend axially further apart from one another toward the outside with an increasing radius.

4. The weight compensation device as claimed in claim 1, wherein the tensile element is a chain.

5. The weight compensation device as claimed in claim 1, wherein the tensile element is a belt.

6. The weight compensation device as claimed in claim 1, wherein the spring element has at least one helical spring.

7. A lifting door having a door leaf which covers the door opening and which can be moved from an open position into a closed position and vice versa by means of a drive, and having a weight compensation device as claimed in claim 1.

* * * * *

UNITED STATES PATENT AND TRADEMARK OFFICE

CERTIFICATE OF CORRECTION

PATENT NO. : 7,798,198 B2
APPLICATION NO. : 12/083356
DATED : September 21, 2010
INVENTOR(S) : Gabrijel Rejc et al.

It is certified that error appears in the above-identified patent and that said Letters Patent is hereby corrected as shown below:

On the Title page, in Item "(75) Inventors", both occurrences of "(SK)" should be changed to -- (SI) --.

On the Title page, in Item "(57) Abstract", delete the "," immediately following "door".

In the Specification:

Column 1, line 16: "Sentijurc" should be changed to -- Sentjurc --.

Signed and Sealed this
Eighteenth Day of January, 2011

David J. Kappos

David J. Kappos
*Director of the United States Patent and Trademark Office*